US010563421B2

(12) United States Patent
Lockhart

(10) Patent No.: US 10,563,421 B2
(45) Date of Patent: Feb. 18, 2020

(54) COLUMBARIUM

(71) Applicant: Bruce Lockhart, Madison, CT (US)

(72) Inventor: Bruce Lockhart, Madison, CT (US)

( * ) Notice: Subject to any disclaimer, the term of this patent is extended or adjusted under 35 U.S.C. 154(b) by 0 days.

(21) Appl. No.: 15/903,198

(22) Filed: Feb. 23, 2018

(65) Prior Publication Data

US 2018/0251998 A1 Sep. 6, 2018

Related U.S. Application Data

(60) Provisional application No. 62/466,792, filed on Mar. 3, 2017.

(51) Int. Cl.
*E04H 13/00* (2006.01)
*A61G 17/08* (2006.01)

(52) U.S. Cl.
CPC ..... *E04H 13/006* (2013.01); *A61G 17/08* (2013.01); *E04H 13/008* (2013.01)

(58) Field of Classification Search
CPC ..... E04H 13/006; E04H 13/008; A61G 17/08
(Continued)

(56) References Cited

U.S. PATENT DOCUMENTS 1,910,780 A * 5/1933 Way ..... E04H 13/00 52/104
2,513,951 A * 7/1950 McClellen ..... E04H 13/006 27/1
(Continued)

FOREIGN PATENT DOCUMENTS

DE 202008003047 U1 6/2008
FR 2681624 B1 * 11/1993 ..... A61G 17/08
(Continued)

OTHER PUBLICATIONS

FR2699583A1 combined document: bibliographic data, translation and original document; accessed Jul. 6, 2018 from world wide web address: https://worldwide.espacenet.com/publicationDetails/biblio?CC=FR&NR=2699583A1&KC=A1&FT=D&ND=3&date=19940624&DB=EPODOC&locale=en_EP (Year: 2018).*

*Primary Examiner* — Patrick J Maestri
*Assistant Examiner* — Joseph J. Sadlon
(74) *Attorney, Agent, or Firm* — DeLio Peterson & Curcio LLC; Thomas E. Ciesco

(57) ABSTRACT

A columbarium for housing a plurality of cremation urns including a columbarium base and a plurality of vertical openings in the base interior, the vertical openings for the storage of cremation urns. The columbarium includes a plurality of slab members secured to the base side surfaces and a lid securable to the slab member upper portions. The columbarium includes a lock assembly for securing the lid to the columbarium base including a slide catch disposed on an interior portion of the lid and a latch assembly having a latch member. The latch assembly is secured to the columbarium base and is rotatingly engageable with the slide catch by rotation of a horizontal shaft having a free end with a male or female portion aligned with the side key opening. The lock assembly includes a key having a male or female portion for mating with the latch assembly shaft. The lid is removable by inserting the key in the key opening, engaging the key male or female portion with the latch assembly shaft male or female portion and rotating the key until a free end of the latch member disengages the slide catch.

22 Claims, 8 Drawing Sheets

(58) Field of Classification Search
USPC ..... 52/134
See application file for complete search history.

(56) References Cited

U.S. PATENT DOCUMENTS

| | | | | | |
|---|---|---|---|---|---|
| 3,182,884 | A * | 5/1965 | Waldron | B65D 81/18 | 220/23.88 |
| 3,287,865 | A * | 11/1966 | Lockman | E04H 13/006 | 52/136 |
| 3,925,944 | A | 12/1975 | Pickel | | |
| RE29,532 | E * | 2/1978 | Zwick | E04H 13/006 | 220/378 |
| 4,328,606 | A * | 5/1982 | Nunes | A61G 17/00 | 27/35 |
| 4,607,417 | A | 8/1986 | Hancovsky | | |
| 4,688,359 | A * | 8/1987 | See | A61G 17/08 | 52/104 |
| 5,815,897 | A | 10/1998 | Longstreth | | |
| 6,161,268 | A | 12/2000 | Joseph | | |
| 6,261,028 | B1 * | 7/2001 | Volpe | E04H 13/006 | 27/1 |
| 6,347,439 | B1 * | 2/2002 | Bach Lahor | E04H 13/006 | 27/1 |
| 6,421,890 | B1 | 7/2002 | Biggar | | |
| 6,513,352 | B1 * | 2/2003 | Mainville | E04H 13/006 | 27/35 |
| 7,131,237 | B2 * | 11/2006 | Pazar | E04H 13/00 | 52/138 |
| 7,421,765 | B1 * | 9/2008 | Kaiser | A61G 17/00 | 27/1 |
| 7,739,776 | B2 * | 6/2010 | Hume | E04H 13/008 | 27/1 |
| 8,245,457 | B2 * | 8/2012 | Eickhof | E04H 13/006 | 52/133 |
| 8,555,561 | B2 * | 10/2013 | Dickinson | E04H 13/003 | 40/124.5 |
| 8,943,762 | B2 * | 2/2015 | Carlson | E04H 13/008 | 211/85.27 |
| 9,051,752 | B1 * | 6/2015 | Muthusami | E04H 13/008 | |
| 9,249,598 | B2 * | 2/2016 | Bridgeman | E04H 13/006 | |
| 9,290,960 | B1 * | 3/2016 | McHale | E04H 13/003 | |
| 9,465,812 | B1 * | 10/2016 | Robinson | G06F 16/29 | |
| 9,690,960 | B1 * | 6/2017 | Lewis | H04B 5/0068 | |
| 10,030,406 | B2 * | 7/2018 | Montgomery | G06F 3/1423 | |
| 10,125,514 | B2 * | 11/2018 | Eickhof | A61G 17/08 | |
| 10,344,497 | B1 * | 7/2019 | Martinez | E04H 13/008 | |
| 2003/0024091 | A1 * | 2/2003 | Berryman | E04H 13/006 | 27/27 |
| 2004/0177570 | A1 * | 9/2004 | Stienwand | E04H 13/006 | 52/133 |
| 2010/0234981 | A1 * | 9/2010 | Turner | B65D 77/048 | 700/215 |
| 2016/0356055 | A1 | 12/2016 | Trousil | | |

FOREIGN PATENT DOCUMENTS

| | | | | |
|---|---|---|---|---|
| FR | 2699583 | A1 * | 6/1994 | E04H 13/006 |
| FR | 2940996 | A1 | 7/2010 | |
| GB | 2264962 | A * | 9/1993 | A61G 17/08 |

* cited by examiner

COLUMBARIUM

BACKGROUND OF THE INVENTION

1. Field of the Invention

The present invention is a columbarium for entombing the ashes of a plurality of people. Entire families can be buried together in one spot, or groups of people can come together as friends, or strangers, in their final resting place.

2. Description of Related Art

After a period of time, cemeteries begin running out of space for placement of caskets and ash urns that are buried in a plot or put in a mausoleum. Without the ability to generate additional income from additional grave sites, they become run down due to a decrease in revenue stream and laying off of personnel to take care of the grounds or other cost related maintenance or repairs. Mausoleums may be able to build upward, but the ability for loved ones to be able to have easy access is lost. The cemeteries or mausoleums are in need of a way to increase the number of urns which may be stored at the facility without losing the ability of friends and family of the deceased to have physical contact with the container holding the ashes.

SUMMARY OF THE INVENTION

Bearing in mind the problems and deficiencies of the prior art, it is therefore an object of the present invention to provide a storage container which may hold a larger number of remains from the cremation of the deceased.

It is another object of the present invention to provide a secure container for cremated ashes which may be locked or unlocked during placement of additional urns which house the ashes.

A further object of the invention is to provide a robust container for cremated ashes which may be placed on the ground and includes multiple openings for a large number of cremation urns.

It is yet another object of the present invention to provide a columbarium having a plurality of openings which allow the stacking of cremation urns.

Still other objects and advantages of the invention will in part be obvious and will in part be apparent from the specification.

The above and other objects, which will be apparent to those skilled in the art, are achieved in the present invention which is directed to a columbarium for housing a plurality of cremation urns. The columbarium includes a columbarium base having side and bottom surfaces, a substantially solid interior within the sides and bottom surface, and a plurality of vertical openings in the base interior, the vertical openings for the storage of cremation urns. The columbarium includes a plurality of slab members secured to the base side surfaces wherein upper edges of the slab members extend above the base side surfaces and a lid securable to the slab member upper portions wherein vertical openings are substantially sealed from exterior elements. The columbarium includes a plurality of insert tubes which are each separately disposed in one of the plurality of vertical openings, the insert tubes each including a cavity for placement of a plurality of cremation urns. The columbarium includes a lock assembly for securing the lid to the columbarium base including a slide catch disposed on an interior portion of the lid and a latch assembly having a latch member. The latch assembly is secured to the columbarium base and is rotatingly engageable with the slide catch by rotation of a horizontal shaft, the shaft having a free end with a male or female portion aligned with the side key opening. The lock assembly includes a key having a male or female portion for mating with the latch assembly shaft, the key having sufficient length to be inserted in the key opening to engage the shaft. The cremation urns are slidingly engageable within the insert tubes. The lid is removable by inserting the key in the key opening, engaging the key male or female portion with the latch assembly shaft male or female portion and rotating the key until a free end of the latch member disengages the slide catch.

The columbarium may include a gasket disposed between the lid and the upper edges of the slab members. The lid may include an upper surface having a convex portion between a pair of substantially flat inclined surfaces, the upper surface preventing water from accumulating on the upper surface. The columbarium may include a latch assembly depression for securing the latch assembly to the columbarium base. The latch assembly may include a latch plate securable to the columbarium base, a first translation gear having a keyed knob engageable with a corresponding key and rotatable by the key handle, a second translation gear engageable with the first translation gear, and a latch for insertion within the slide catch. The columbarium base may include a forklift channel along the bottom flange for the insertion of a forklift fork. The columbarium may include a threaded rod secured to a bottom portion of the column barium and extending to a latch assembly depression, the latch assembly base securable in the depression with the threaded rod and an upper nut. The columbarium may include a removable eye bolt having an eye bolt opening and a female threaded opening disposed on a lower portion of the eye bolt, the female threaded opening engageable with a portion of the threaded rod extending above the upper nut wherein the eye bolt is attached to a lifting device for relocation of the columbarium. The columbarium the slab members and lid may be granite. The columbarium may include at least one steel reinforcement member imbedded in a lower portion of the columbarium base.

Another embodiment is directed to a columbarium comprising a columbarium base having a plurality of vertical openings for the storage of cremation urns, the base including a top rim and a side key opening below the top rim. The columbarium includes a lid engageable with the top rim wherein an interior portion of the columbarium is substantially sealed from exterior elements. The columbarium includes a slide catch disposed on an interior portion of the lid and a latch assembly having a latch member secured to the columbarium base rotatingly engageable with the slide catch by rotation of a horizontal shaft. The shaft has a free end with a male or female portion aligned with the side key opening. A key having a male or female portion mates with the latch assembly shaft. The key has sufficient length to be inserted in the key opening to engage the shaft. The cremation urns are slidingly engageable within the insert tubes. The lid is removable by inserting the key in the key opening, engaging the key male or female portion with the latch assembly shaft male or female portion and rotating the key until a free end of the latch member disengages the slide catch. The lid includes a groove along the bottom surface for engaging the rim of the columbarium base and an upper surface having a convex portion between a pair of substantially flat inclined surfaces, the upper surface preventing water from accumulating on the upper surface. A latch assembly depression is disposed in the columbarium for securing the latch assembly to the columbarium base. A latch assembly includes latch plate securable to the columbarium base, a first translation gear having a keyed knob engageable with a corresponding key and rotatable by the key handle, a second translation gear engageable with the first translation gear, and a latch for insertion within the slide catch. A threaded rod is secured to a bottom portion of the columbarium and extends to a latch assembly depression, the latch assembly base securable in the depression with the threaded rod and an upper nut. The columbarium base may include a forklift channel along the bottom flange for the insertion of a forklift fork. The columbarium may include a removable eye bolt having an eye bolt opening and a female threaded opening disposed on a lower portion of the eye bolt, the female threaded opening engageable with a portion of the threaded rod extending above the upper nut wherein the eye bolt is attached to a lifting device for relocation of the columbarium. The columbarium base and lid may be formed from concrete and may include at least one steel reinforcement member imbedded in a lower portion of the columbarium base.

Another embodiment is directed to a method for using the columbarium for housing a plurality of cremation urns, the method comprises inserting the key in the keyhole, engaging the key with the keyed bolt and rotating the key handle to disengage the latch from the slide catch. The method includes removing the columbarium lid, inserting the at least one urn into one of the plurality of insert tubes and allowing the at least one urn to slide into the lowest available portion of the insert tube. The method includes replacing the columbarium lid, inserting the key into the keyhole, rotating the key handle to engage the latch with the slide catch and removing the key from the keyhole. A method for relocating the columbarium may include removing the columbarium lid, attaching the eyebolt to the threaded rod, attaching the eye bolt to the lifting device and using the lifting device to move the columbarium. The eye bolt may then be disconnected from the lifting device and the eyebolt may then be removed from the threaded rod by rotating the eye bolt until the eye bolt is disengaged from the threaded rod. The lid may then be replaced and the lid secured to the columbarium base and locked.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENTS

In describing the embodiment of the present invention, reference will be made herein to FIGS. 1-13 of the drawings in which like numerals refer to like features of the invention.

Figure 1:
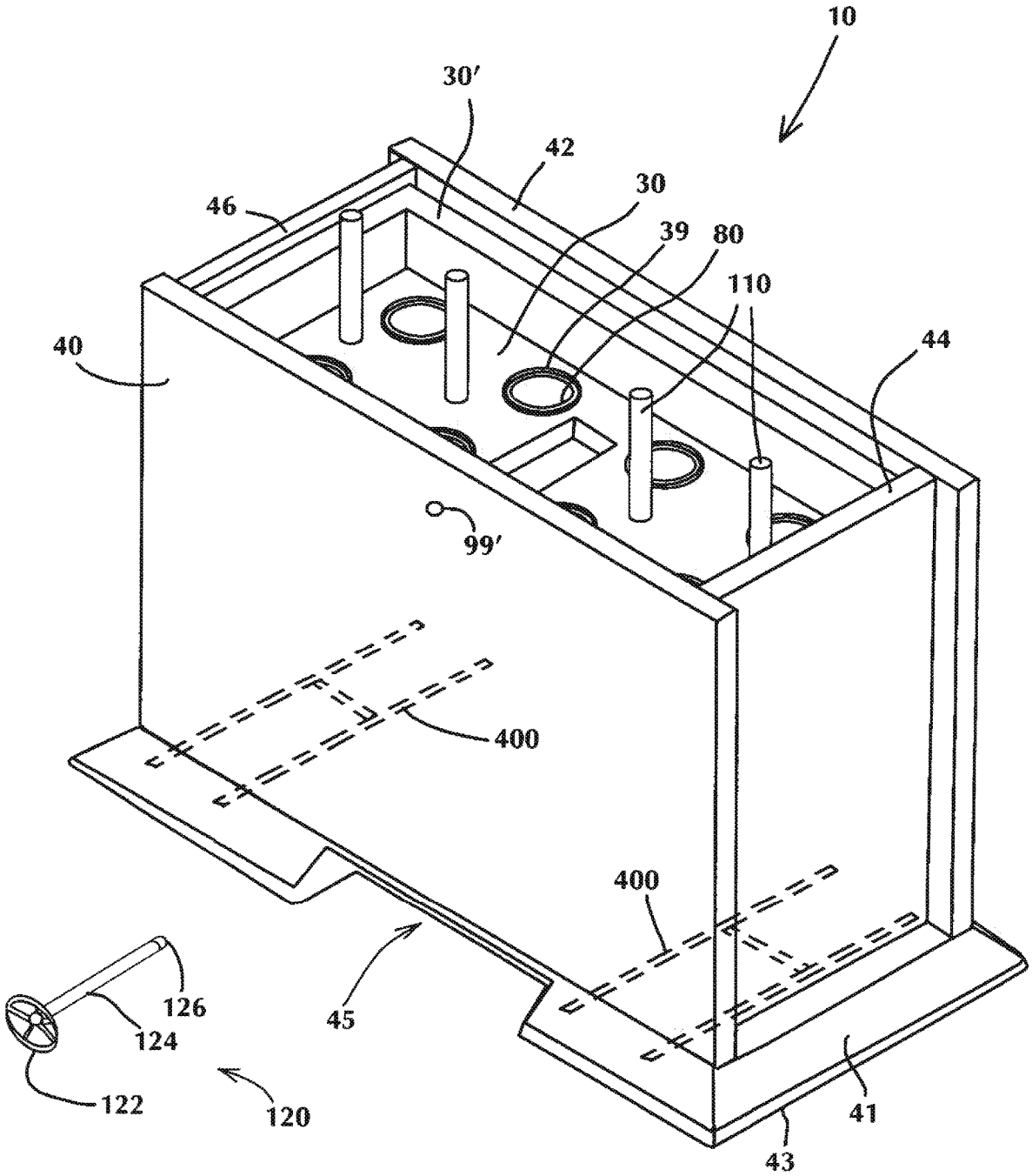
FIG. 1 is a perspective view of the columbarium base according to the present invention.
Figure 2:
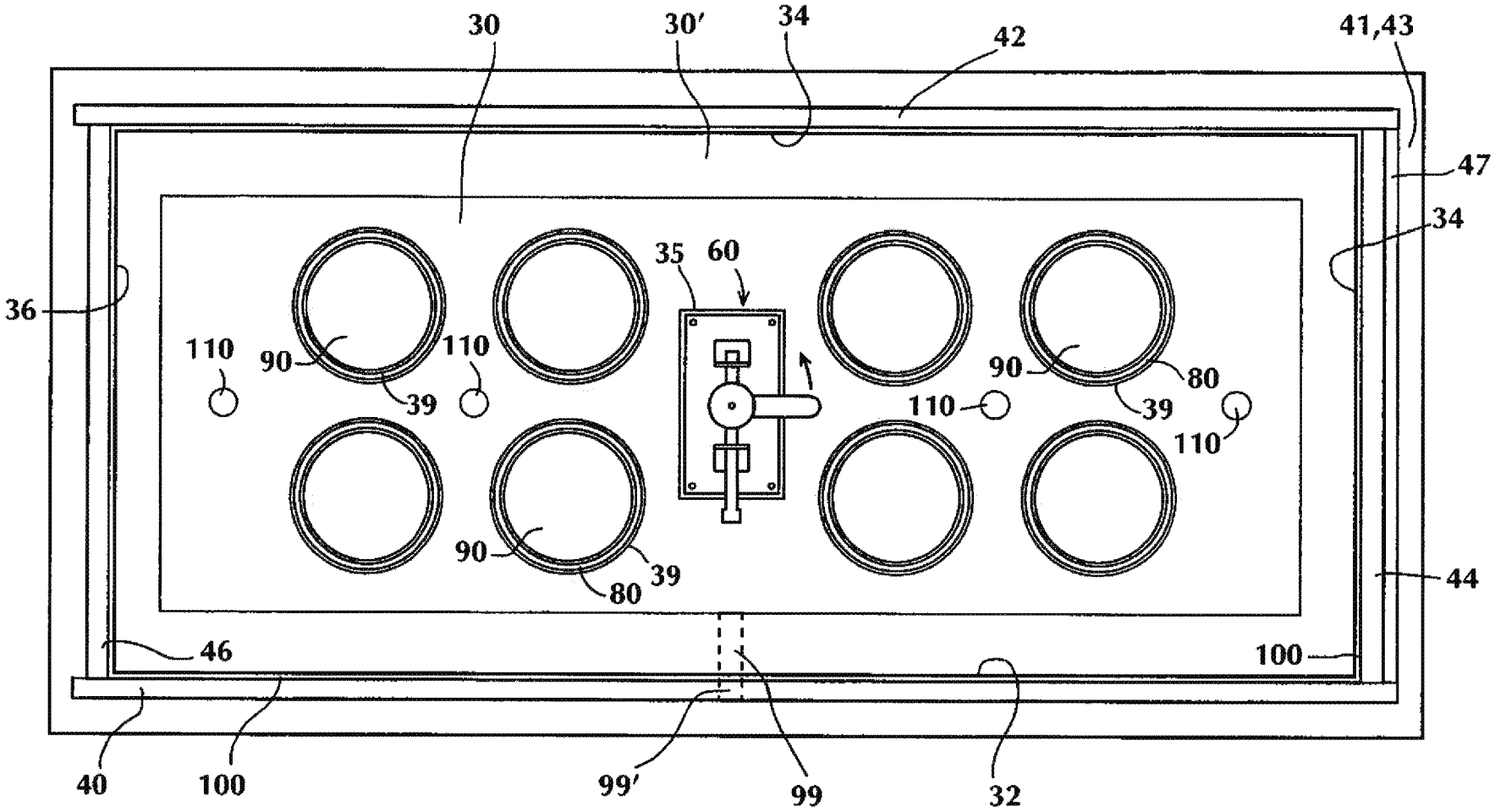
FIG. 2 is a top plan view of the columbarium shown in FIG. 1.
Figure 6:
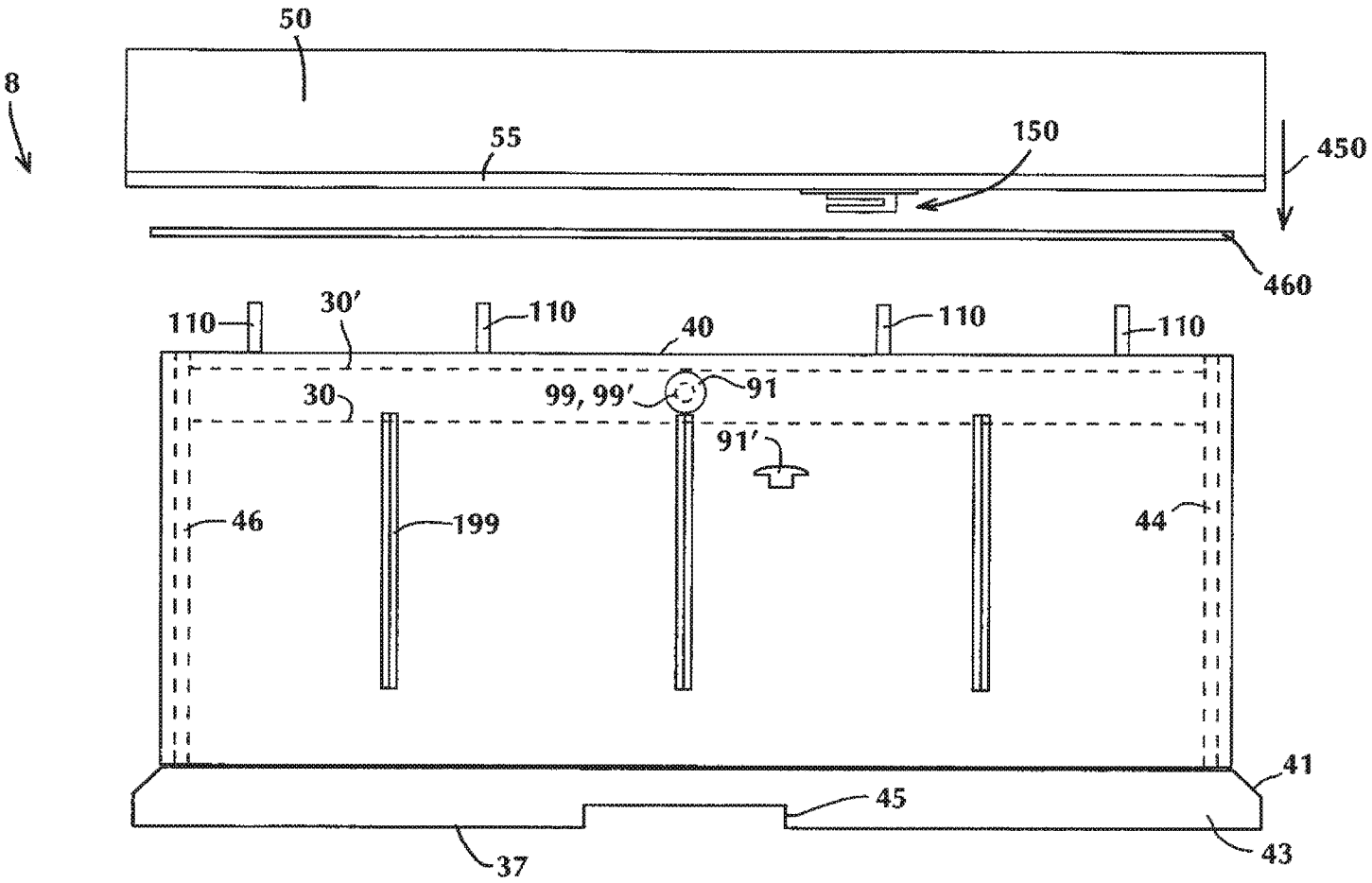
FIG. 6 is an exploded front elevational view of the columbarium shown in FIG. 1 and the columbarium lid and gasket.
Figure 7:
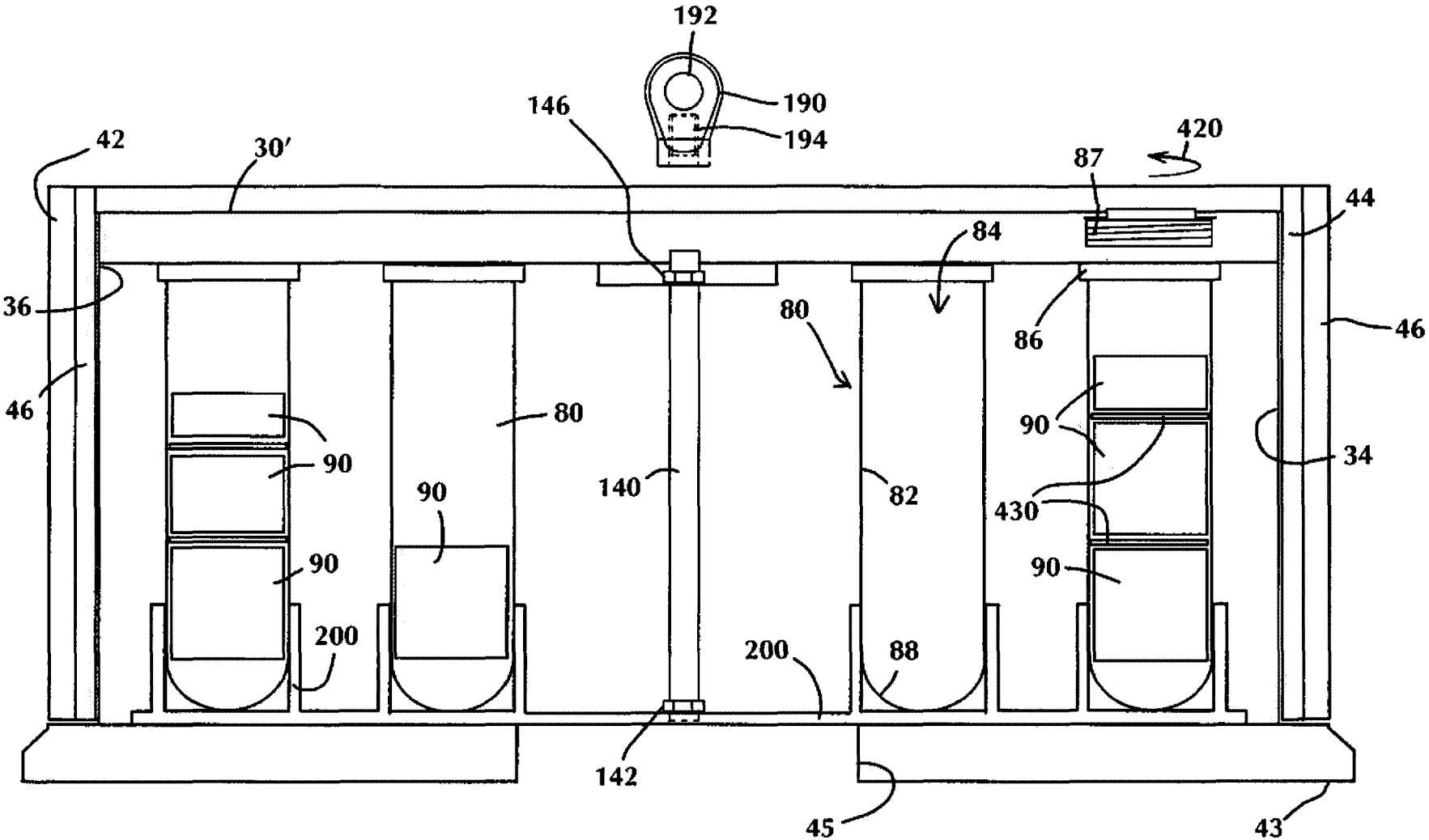
FIG. 7 is a cross sectional view of the columbarium shown in FIG. 6.
Figure 8:
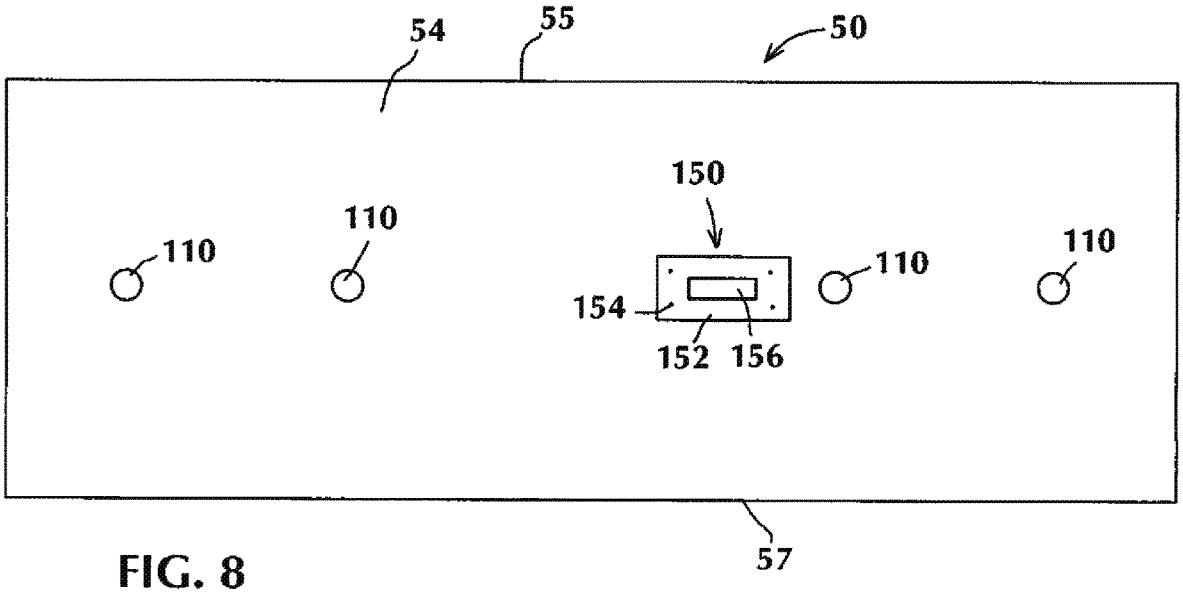
FIG. 8 is a bottom elevational view of the columbarium lid according to the present invention.
Figure 9:
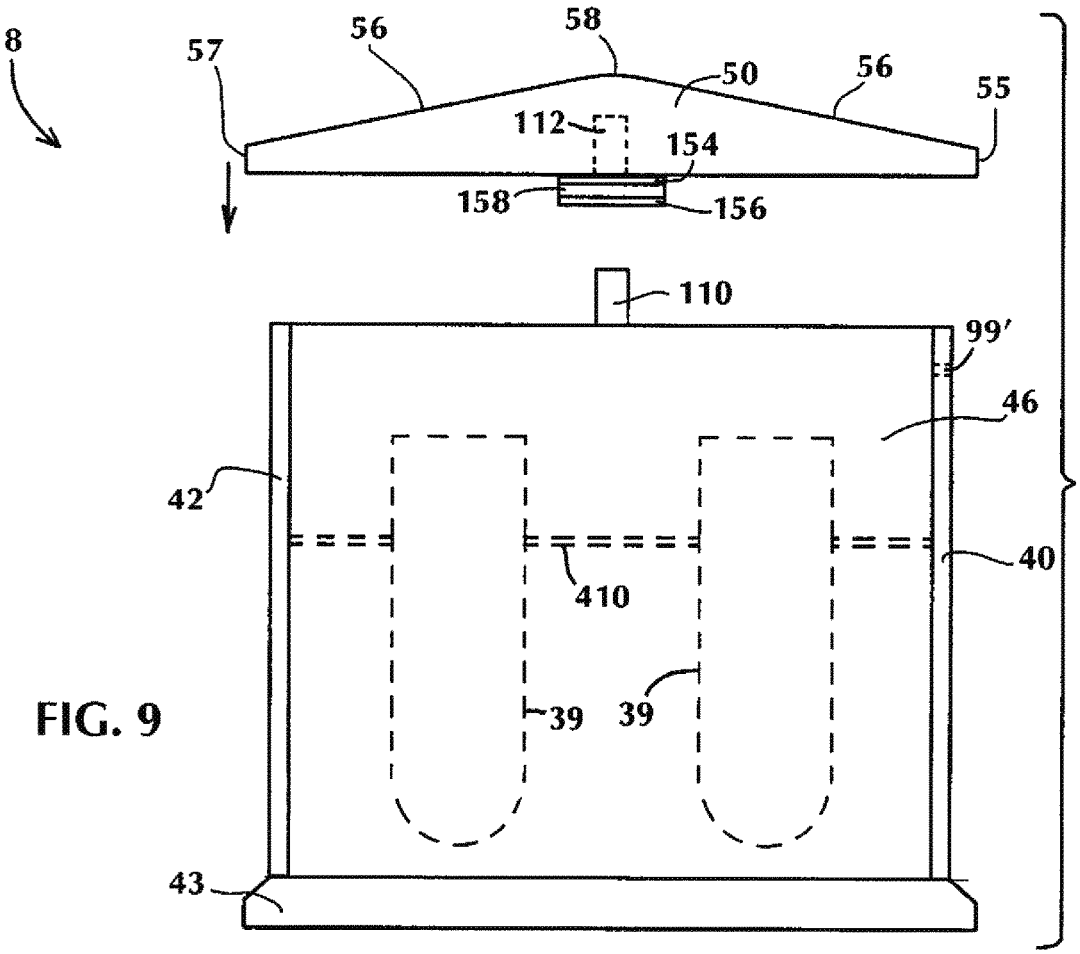
FIG. 9 is an exploded left side elevational view of the columbarium and lid shown in FIG. 6.

In a first embodiment, the columbarium 8 as shown in FIGS. 6 and 9 and the columbarium base 10 as shown in FIGS. 1, 2 and 7 includes the columbarium base 10 having side surfaces 32, 34, 36, 38 and a bottom surface 37, a substantially solid interior within the sides and bottom surfaces, and plurality of vertical openings 39 in the base interior, the vertical openings 39 for the storage of cremation urns 90. The columbarium 8 includes a slab front member 40 secured to the base side surface 32, a slab rear member 42 secured to the base side surface 34, and slab end members 44, 46 secured to the base side surfaces 36, 38, respectively. An upper portion of each slab member 40, 42, 46, 48 extends above the base side surfaces 32, 34, 36, 38. A lid 50 is engageable with the upper portion of each slab member 40, 42, 46, 48 wherein vertical openings 39 are substantially sealed from exterior elements. The lid 50 includes a bottom surface 54 for contacting the slab member upper edge. The lid 50 includes an upper surface having a convex portion 58 between a pair of substantially flat inclined surfaces 56, the upper surface preventing water from accumulating on the upper surface. The columbarium base includes a plurality of alignment posts 110 which engage the lid alignment openings 112 and aid in ensuring the lid 50 is properly placed on the columbarium base 10. There may be any number of alignment posts 110 and alignment openings 112 although four are shown in the embodiment of FIG. 1. The columbarium base 10 includes a bottom surface 37 and may include a reinforcement frame 400 made of steel or other reinforcement material. The reinforcement frame 400 may have configurations other than that shown and should extend to portions of the flange 43 to prevent damage during movement or usage of the columbarium base 10.

Figure 6A:
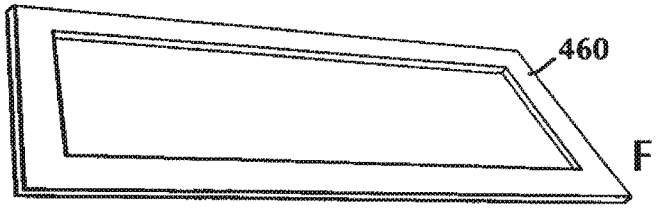
FIG. 6A is a perspective view of the gasket shown in FIG. 6.

FIGS. 6 and 6A show a pliable gasket 460 which is disposed between the lid 50 and the columbarium base 8 and is used for sealing the interior of the columbarium base from the exterior elements such as rain, snow and wind when the lid 50 is secured to the columbarium base 10. The lid front edge 55 and rear edge 57 may be flat as shown in FIG. 7, or may alternately be rounded to prevent damage along the edges 55, 57. The columbarium 8 includes a plurality of insert tubes 80 which are each separately disposed in one of the plurality of vertical openings 39. The insert tubes 80 each include tube sides 82, tube top rim 86, tube bottom portion 88 and a cavity 84 for placement of a plurality of cremation urns. An insert cap 87 may include threads engageable with tube threads on an upper portion of the insert tubes 80. The tube bottom portion 88 may be semi-spherical. The tube bottom portion 88 may alternately be flat. The insert tubes 80 and vertical openings 39 are cylindrical although any shape may be used. Any number of urns 90 may be placed in each insert tube 80, depending on the size of each urn 90. The columbarium shown is partially occupied by the urns 90 and includes only a sample of the urn sizes which may be stored. The chambers or vertical openings 39 has a plastic or metal separation disk 430 separating each urn 90 from one another.

Figure 3:
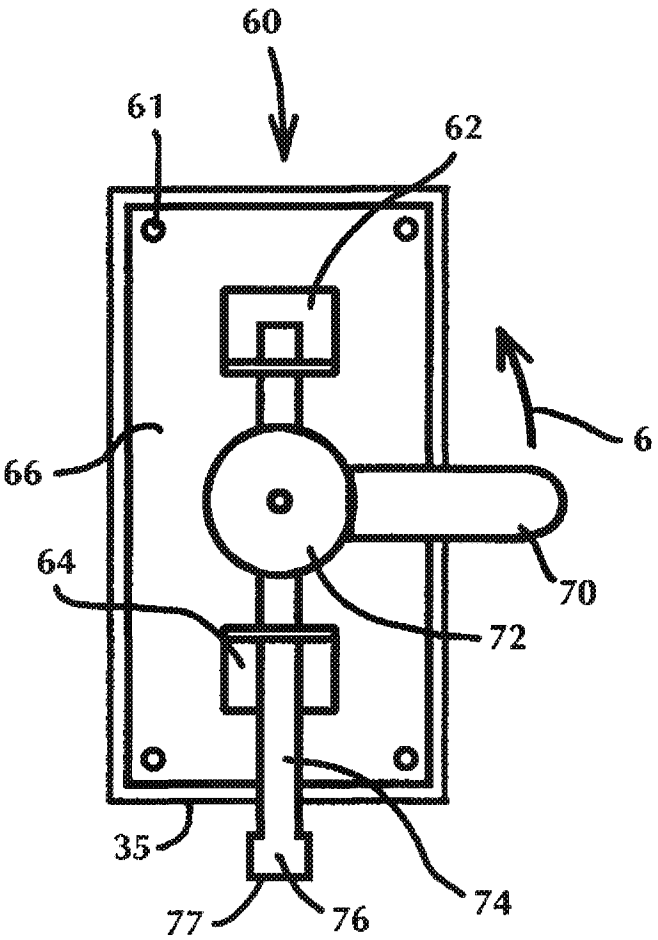
FIG. 3 is a top plan view of the latch assembly shown in FIG. 2.
Figure 10:
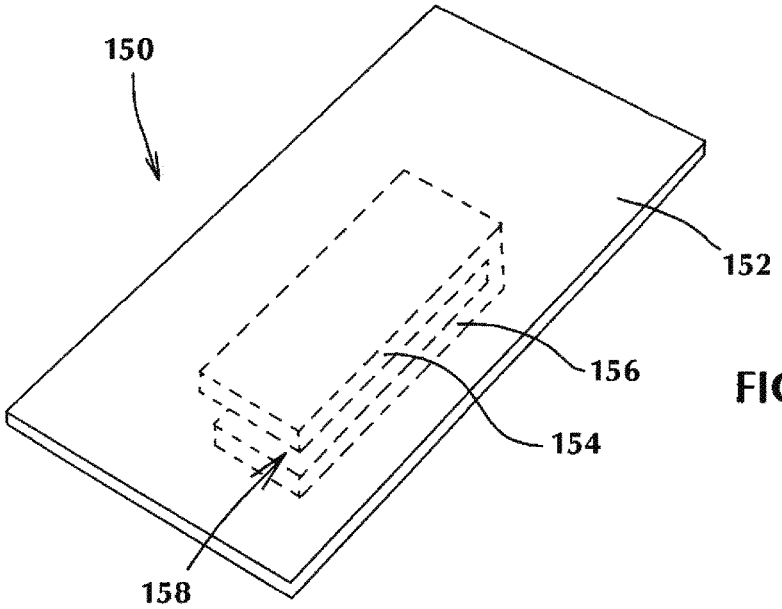
FIG. 10 is a perspective view of the slide catch according to the present invention.
Figure 11:
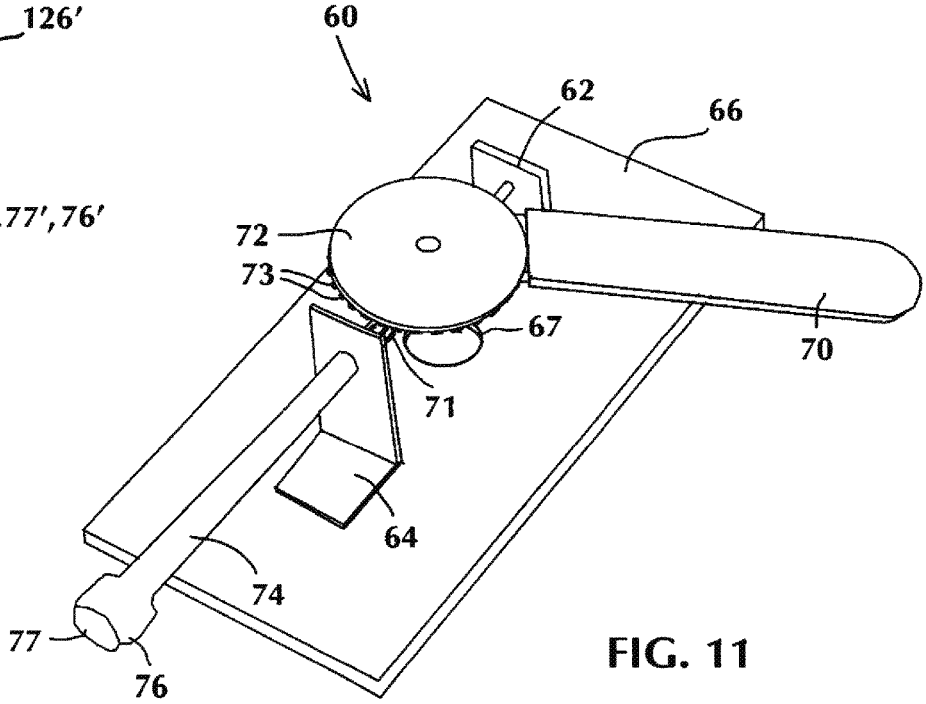
FIG. 11 is a perspective view of the latch assembly according the present invention.

The elevational view of FIG. 2 shows the keyhole openings 99, 99' which extend through the columbarium rim 30' and the front slab member 40, respectively. As shown in FIGS. 3, 10 and 11, the columbarium 8 includes a slide catch assembly 150 disposed on the lid bottom surface 54 and a latch assembly 60 having a latch member 70 engageable with the slide catch assembly 150 for locking the lid 50 on the columbarium base 10. The slide catch assembly 150 includes a slide catch plate 152 securable to the lid bottom surface 54, an upper slide catch 154, a lower slide catch 156 and a slide catch groove 158 disposed between the upper slide catch 154 and lower slide catch 156. A latch assembly 60 is secured to the columbarium base. The latch assembly includes a latch plate 66 secures to a depression 35 in the columbarium base 30. A pair of brackets 62, 64 disposed on the latch plate 66 engage a rotatable shaft 74 having a keyed knob 76 and first translation gear teeth 71 on the rotatable shaft rotatable by a key 120. The key 120 includes a key handle 122, a key extension 124 and key end 126 lockingly engageable with the keyed knob 76. The latch assembly 60 includes a second translation gear 72 having teeth 73 engageable with the first translation gear teeth 71 and a latch 70 attached to the second translation gear 72. The latch 70 is engageable with the slide catch groove 158 between the upper slide catch 154 and lower slide catch 156. Once the latch 70 is engaged in the slide catch groove 158, the lid 50 in locked in position on top or the columbarium base 30, preventing access to urns 90 in the vertical openings 39. The latch assembly shaft 74 includes a free end having the keyed knob 76 with a male or female portion 77 aligned with the side key openings 99, 99'. The columbarium includes a key 120 having a key male or female portion 126 for mating with the latch assembly shaft free end 76, the key 120 having a key shaft 124 with sufficient length to be inserted in the key openings 99, 99' to engage the latch assembly shaft free end 76. The cremation urns 90 are slidingly engageable within the insert tubes 80. The lid 50 is removable by inserting the key in the key opening, engaging the key male or female portion with the latch assembly shaft male or female portion and rotating the key until a free end of the latch member disengages the slide catch. Key opening 99' extends through the front slab member 40 and may include a key opening plug 91 engaged with the key opening 99' as shown in a front view in FIG. 6. An additional side view of the key opening plug 91' is shown adjacent the key opening 99' for reference.

FIG. 3 shows a top view of the latch assembly 60 and includes latch fastener openings 61 which may be used to secure the latch assembly 60 in the columbarium base depression 35. As shown in FIG. 11, a plate opening 67 may be disposed on latch plate 66 so that the threaded rod 140 may extend through the plate opening and the upper nut 146 engages with the threaded rod 140 above the plate opening 69 to secure the latch assembly 60 to the columbarium base 30 with the top end of the threaded rod 140 disposed just below the second translation gear 72, FIG. 7 not showing the latch assembly.

Figure 4:
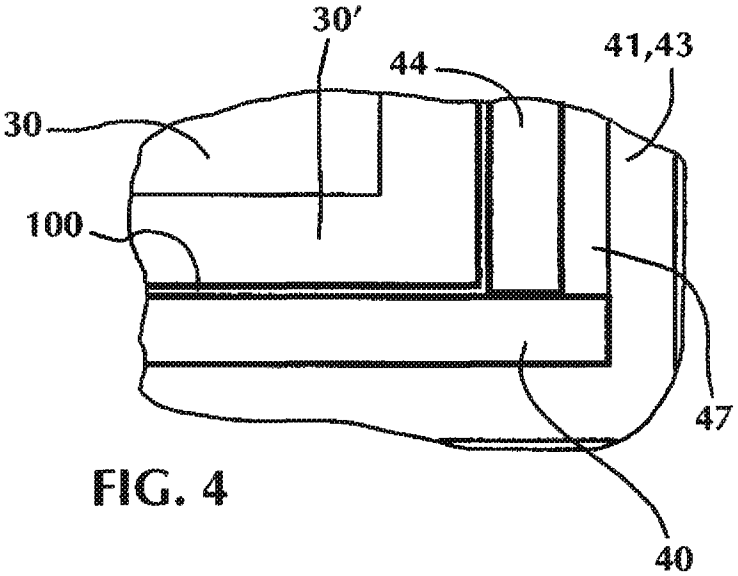
FIG. 4 is an enlarged view of a corner portion of the columbarium shown in FIG. 2.
Figure 5:
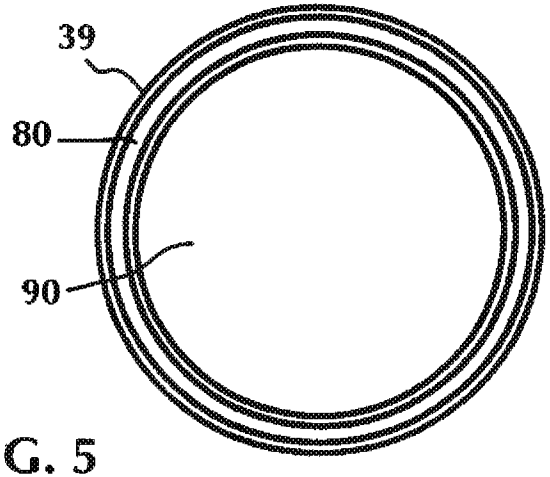
FIG. 5 is an enlarged view of a vertical opening and insert tube of the columbarium shown in FIG. 2.

FIG. 4 shows a top enlarged view of a corner of the columbarium base 10. The front slab overlaps the side slab member 44 with the bottom edge of each contacting a flat horizontal portion 47 of the columbarium base adjacent the flange 43. The flat horizontal portion 47 supports the slab members 40, 42, 44, 46 so that slab member damage may be prevented.

The columbarium base 30 includes a forklift channel 45 along the bottom flange 43 for the insertion of a forklift fork. The bottom flange 43 includes a bevel 41 so the bottom flange 43 is not easily chipped or damaged.

The columbarium includes a threaded rod 140 secured to a bottom portion of the columbarium base 8 and extends to the latch assembly depression 35, the latch plate 66 is securable in the depression 35 with the threaded rod 140 and an upper nut 146. The latch plate 66 is alternately securable in the depression 35 with fasteners 61.

The columbarium 8 includes a removable eye bolt 190 having an eye bolt opening 192 and a female threaded opening 194 disposed on a lower portion of the eye bolt 190, the female threaded opening 194 engageable with a portion of the threaded rod 140 extending above the upper nut 146 wherein the eye bolt 190 is attached to a lifting device for relocation of the columbarium 8.

The columbarium exterior tiles or slab members 40, 43, 44, 46 and lid 50 are preferably made of granite while the columbarium base (not including the slab members) is preferably concrete. At least one steel reinforcement member 200 is imbedded in a lower portion of the columbarium base 30 for strengthening the columbarium base 30. The steel reinforcement member 200 may be used to reinforce the vertical openings 39, the forklift channel 45 or any other portion of the columbarium structure.

FIG. 9 shows a left side elevational view of the columbarium 8. A wire mesh 410 may be embedded in the columbarium base 10 for added structural integrity. The wire mesh includes large circular mesh openings juxtaposed with the vertical openings 39 to allow the insert tubes 80 to be inserted into the vertical openings 39.

Figure 12:
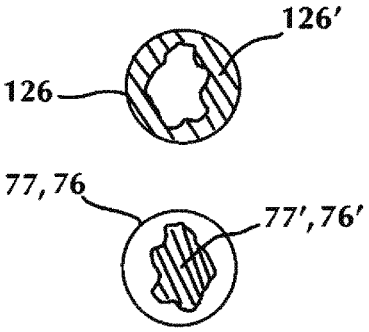
FIG. 12 is an end view of an example of the keyed end and mating key knob.

FIG. 12 shows the keyed knob 76 and key end 126 which mate or engage one another. The keyed knob 76 includes a key knob raised portion 76' and the keyed end 126 includes a key end raised portion 126' with the identical outline so the keyed knob 76 and key end 126 engage one another in an exclusive arrangement so that other keys may not engage the key knob 76. Alternately, the portion of the key knob and key end that is highlighted may be a depressed portion, as long as they are able to engage one another during rotation of the key 120. The shape and structure of the raised or depressed portion is different for each columbarium made so that only the key made for a specific columbarium may be used to open that columbarium.

In another embodiment, the columbarium 8 comprises a columbarium base 10 having a plurality of vertical openings 39 for the storage of cremation urns 90, the base 10 including a top rim 30' and a side key opening 99 below the top rim 30'. The columbarium 8 includes a lid 50 engageable with an upper edge of the columbarium base 8 wherein an interior portion of the columbarium 8 is substantially sealed from exterior elements. The columbarium 8 includes a slide catch disposed on an interior portion of the lid 50 and a latch assembly 60 having a latch member 70, the latch assembly 60 secured to the columbarium base 10 and rotatingly engageable with the slide catch 150 by rotation of a horizontal shaft 74. The shaft 74 has a free end 76 with a male or female portion 77 aligned with the side key opening 99. A key 120 having a male or female portion 126 mates with the latch assembly shaft. The key has sufficient length to be inserted in the key opening to engage the shaft male or female portion 77. The cremation urns 90 are slidingly engageable within the insert tubes 80. The lid 50 is removable by inserting the key 120 in the key opening 99, engaging the key male or female portion 126 with the latch assembly shaft male or female portion 77 and rotating the key until a free end of the latch member disengages the slide catch. The lid 50 includes an upper surface having a convex portion 58 between a pair of substantially flat inclined surfaces 56, the upper surface inclined surfaces 56 preventing water from accumulating on the lid 50. A latch assembly depression 35 is disposed in the columbarium base 10 for securing the latch assembly 60 to the columbarium base 10. The latch assembly 60 includes latch plate 66 securable to the columbarium base 10, first translation gear teeth 71 disposed on the shaft 74, the shaft 74 having a keyed knob 76 engageable with a corresponding key 120 and rotatable by the key handle 122, a second translation gear 72 having second translation gear teeth 73 engageable with the first translation gear teeth 71, and a latch 70 for insertion within the slide catch 150. A threaded rod 140 is secured to a bottom portion of the columbarium base 10 with a bottom nut 142 secured in the columbarium base 10 and extends to the latch assembly depression 35, the latch assembly base plate 66 securable in the depression 35 with an upper portion of the threaded rod 140 and an upper nut 146.

The columbarium base 10 includes a forklift channel 45 along the bottom flange 43 for the insertion of a forklift fork. The columbarium 8 includes a removable eye bolt 190 having an eye bolt opening 192 and a female threaded opening 194 disposed on a lower portion of the eye bolt 190, the female threaded opening 194 engageable with a portion of the threaded rod extending above the upper nut 146 wherein the eye bolt 190 is attached to a lifting device for relocation of the columbarium 8. The columbarium base 10 may be formed from concrete and includes at least one steel reinforcement member 200 imbedded in a lower portion of the columbarium base 10.

Figure 13:
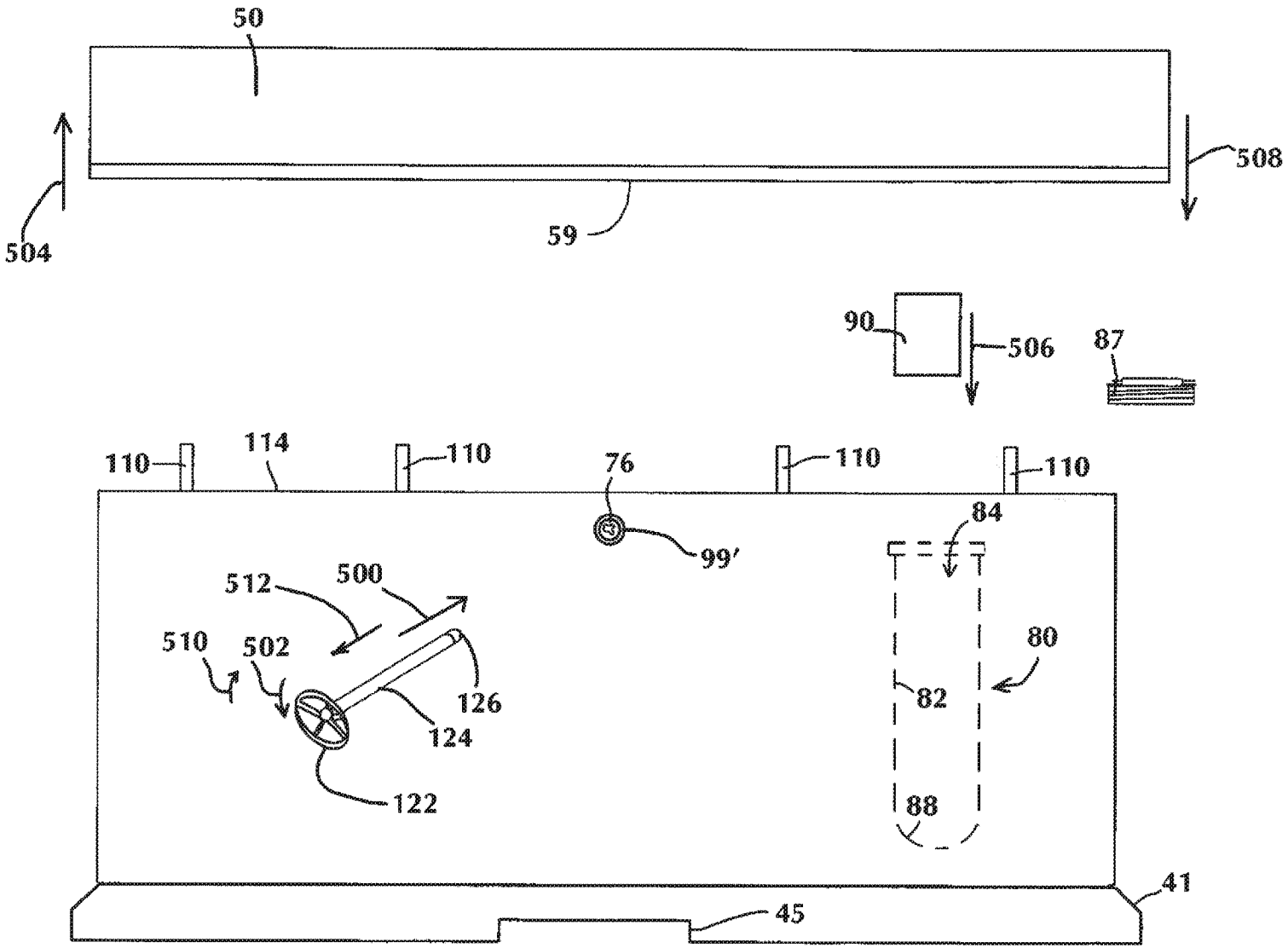
FIG. 13 is a front view showing the steps in using the columbarium.

FIG. 13 shows a method for using a columbarium for housing a plurality of cremation urns 90. The method includes inserting the key 120 in the keyhole 99, 99' engaging the key end 126 with the keyed bolt 76 shown by arrow 500, rotating the key handle 122 in the direction of arrow 502 which disengages the latch 70 from the slide catch 150 unlocking the lid 50 from the columbarium base 10 and removing the key in the direction of arrow 512. The method includes removing the columbarium lid 50 in the direction of arrow 504, inserting at least one urn 90 into one of the insert tubes 80 as shown by arrow 506 and allowing the urn 90 to slide into the lowest available portion of the insert tube 80. The method includes replacing the columbarium lid 50 as shown by arrow 508 until the lid bottom surface 59 contacts an upper edge 114 of the columbarium base 10 and inserting the key 120 in the keyhole 99, 99' engaging the key end 126 with the keyed bolt 76 shown by arrow 500, rotating the key handle 122 in the direction of arrow 510 which engages the latch 70 to the slide catch 150 locking the lid 50 to the columbarium base 10 and removing the key in the direction of arrow 512. The method may include removing the insert tube cap 87 (FIG. 7), preferably by rotating the cap 87 before inserting the at least one urn 90 into the insert tube 80 and replacing the cap 87 after inserting the at least one urn 90 into the insert tube 80.

In a method for relocating the columbarium using FIG. 7 as a reference, an attendant or other removes the columbarium lid 50 and nut 46 to release the latch assembly, removes the latch assembly 60 and attaches the eyebolt 190 to the threaded rod by engaging the eyebolt threads 194 with the top portion of the threaded rod 140. The attendant then attaches the eye bolt 190 to the lifting device, preferably by threading a strap or wire cord through the eyebolt opening 192 and uses the lifting device to lift and move the columbarium. The eye bolt may then be disconnected from the lifting device and the eyebolt may then be removed from the threaded rod by rotating the eye bolt until the eye bolt is disengaged from the threaded rod. The latch assembly 60 may then be reattached using bolt 146. The lid 50 may then be replaced and the lid 50 secured to the columbarium base and locked.

Here, an example of the columbarium is described. The columbarium may comprise eight vertical openings 39 and each vertical opening 39 may hold a plurality of urns. The number of urns 90 which may be placed in a vertical opening is only limited by the height of the urns 90, each urn having its own physical dimensions. The urns may be separated inside each chamber by a thick disk 430 which may be plastic, metal or other material, the disk positioned between adjacent urns. Names and dates are on the face and back of the columbarium. Each may be placed on a plaque on the columbarium outer surface or may be inscribed directly on the columbarium base.

After inserting an urn 90 and replacing the columbarium lid 50, a monument company may send an engraver to the cemetery to inscribe the names, dates, and other inscriptions on the outside of the column barium.

Although other materials may be used, the columbarium may be constructed using concrete and steel for the columbarium base, PVC for the tube inserts and granite for the lid 50 and exterior tiles.

Thus, the present invention provides one or more of the following advantages:

A storage container which may hold a larger number of remains from the cremation of the deceased.

A secure container for cremated ashes which may be locked or unlocked during placement of additional urns which house the ashes.

A robust container for cremated ashes which may be placed on the ground and includes multiple openings for a large number of cremation urns.

A columbarium having a plurality of openings which allow the stacking of cremation urns.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A columbarium for housing a plurality of cremation urns comprising:

a columbarium base having side and bottom surfaces, a substantially solid interior within the sides and bottom surface, a top rim extending from the base sides and a plurality of vertical openings in the base interior, the vertical openings for the storage of cremation urns;

a plurality of slab members secured to the base side surfaces wherein upper edges of the slab members extend above the base side surfaces and top rim, at least one of the slab members having a side key opening;

a lid securable to the slab member upper edges wherein the vertical openings are substantially sealed from exterior elements;

a plurality of insert tubes which are each separately disposed in one of the plurality of vertical openings, the insert tubes each including a cavity for placement of a plurality of cremation urns; and a lock assembly for securing the lid to the columbarium base including:

a slide catch disposed on an interior portion of the lid;

a latch assembly having a latch member; the latch assembly secured to the columbarium base and rotatingly engageable with the slide catch by rotation of a horizontal shaft, the shaft having a free end with a male or female portion aligned with the side key opening; and a key having a male key or female key portion for mating with the latch assembly shaft, the key having sufficient length to be inserted in the key opening to engage the shaft;

wherein the cremation urns are slidingly engageable within the insert tubes; and wherein the lid is removable by inserting the key in the key opening, engaging the key male or female portion with the latch assembly shaft male or female portion and rotating the key until a free end of the latch member disengages the slide catch.

2. The columbarium of claim 1 including a gasket disposed between the lid and the upper edges of the slab members.

3. The columbarium of claim 1 wherein the lid includes an upper surface having a convex portion between a pair of substantially flat inclined surfaces, the upper surface preventing water from accumulating on the upper surface.

4. The columbarium of claim 1 wherein the columbarium includes a latch assembly depression for securing the latch assembly to the columbarium base.

5. The columbarium of claim 1 wherein the latch assembly includes a latch plate securable to the columbarium base, a first translation gear having a keyed knob engageable with the key and rotatable by a key handle, a second translation gear engageable with the first translation gear wherein the latch member is attached to the second translation gear for insertion within the slide catch.

6. The columbarium of claim 1 wherein the columbarium base includes a forklift channel along the bottom flange for the insertion of a forklift fork.

7. The columbarium of claim 1 including a threaded rod secured to a bottom portion of the columbarium and extending to a latch assembly depression, the latch assembly base securable in the depression with the threaded rod and an upper nut.

8. The columbarium of claim 7 including a removable eye bolt having an eye bolt opening and a female threaded opening disposed on a lower portion of the eye bolt, the female threaded opening engageable with a portion of the threaded rod extending above the upper nut wherein the eye bolt is capable of being attached to a lifting device for relocation of the columbarium.

9. The columbarium of claim 1 wherein the slab members and lid are granite.

10. The columbarium of claim 9 including at least one steel reinforcement member imbedded in a lower portion of the columbarium base.

11. The columbarium of claim 1 including inscription on the outside of at least one of the columbarium slab members.

12. The columbarium of claim 1 wherein the columbarium base includes a plurality of alignment posts, each alignment post engagable with a corresponding lid alignment opening for ensuring the lid is properly placed on the columbarium base upon placement of the lid on the columbarium base.

13. A columbarium for housing a plurality of cremation urns comprising:

a columbarium base having a plurality of vertical openings for the storage of cremation urns, the base including sides, a top rim extending above the base sides and a side key opening below the top rim;

a lid engageable with the top rim wherein an interior portion of the columbarium is substantially sealed from exterior elements;

a slide catch disposed on an interior portion of the lid;

a latch assembly having a latch member; the latch assembly secured to the columbarium base and rotatingly engageable with the slide catch by rotation of a horizontal shaft, the shaft having a free end with a male or female portion aligned with the side key opening; and a key having a male or female portion for mating with the latch assembly shaft, the key having sufficient length to be inserted in the key opening to engage the shaft;

wherein the cremation urns are slidingly engageable within the vertical openings; and wherein the lid is removable by inserting the key in the key opening, engaging the key male or female portion with the latch assembly shaft male or female portion and rotating the key until a free end of the latch member disengages the slide catch.

14. The columbarium of claim 13 including a gasket disposed between the lid and the top rim of the columbarium base.

15. The columbarium of claim 13 wherein the lid includes an upper surface having a convex portion between a pair of substantially flat inclined surfaces, the upper surface preventing water from accumulating on the upper surface.

16. The columbarium of claim 13 wherein the columbarium includes a latch assembly depression for securing the latch assembly to the columbarium base.

17. The columbarium of claim 13 wherein the latch assembly includes a latch plate securable to the columbarium base, a first translation gear having a keyed knob engageable with the key and rotatable by a key handle, a second translation gear engageable with the first translation gear, and a latch for insertion within the slide catch.

18. The columbarium of claim 13 wherein the columbarium base includes a forklift channel along the bottom flange for the insertion of a forklift fork.

19. The columbarium of claim 13 including threaded rod secured to a bottom portion of the columbarium and extending to a latch assembly depression, the latch assembly base securable in the depression with the threaded rod and an upper nut.

20. The columbarium of claim 19 including a removable eye bolt having an eye bolt opening and a female threaded opening disposed on a lower portion of the eye bolt, the female threaded opening engageable with a portion of the threaded rod extending above the upper nut wherein the eye bolt is capable of being attached to a lifting device for relocation of the columbarium.

21. A method for using a columbarium for housing a plurality of cremation urns, the method comprising:

providing a columbarium base having base sides and a plurality of vertical openings, a top rim extending upwardly from the base sides, a side key opening below the top rim, a lid engageable with the top rim, a slide catch disposed on an interior portion of the lid, a latch assembly secured to the columbarium base, the latch assembly having a latch member and being rotatingly engageable with the slide catch by rotation of a horizontal shaft, the horizontal shaft having a free end with a male or female portion aligned with the side key opening and a key having a male or female portion for mating with the horizontal shaft, the key having sufficient length to be inserted in the key opening to engage the shaft;

providing at least one urn;

inserting the key in the key opening, engaging the key with the free end of the shaft;

rotating the key to disengage the latch from the slide catch;

removing the columbarium lid;

inserting the at least one urn into one of the plurality of vertical openings;

allowing the at least one urn to slide into the lowest available portion of the insert tube;

replacing the columbarium lid;

inserting the key into the key opening;

rotating the key handle to engage the latch with the slide catch; and removing the key from the key opening.

22. The method for using a columbarium according to claim 21 further including:

providing a removable eye bolt having an eye bolt opening and a female threaded opening disposed on a lower portion of the eye bolt, the female threaded opening engageable with a portion of the threaded rod extending above the upper nut wherein the eye bolt is attachable to a lifting device for relocation of the columbarium;

removing the columbarium lid;

attaching the eyebolt to the threaded rod;

providing a lifting device;

attaching the eye bolt to the lifting device;

using the lifting device to move the columbarium;

removing the eye bolt from the lifting device;

removing the eye bolt from the threaded rod; and replacing the lid.

* * * * *